US006874450B2

(12) United States Patent
Hwang et al.

(10) Patent No.: US 6,874,450 B2
(45) Date of Patent: Apr. 5, 2005

(54) ENGINE COOLING SYSTEM

(75) Inventors: Gyu-Han Hwang, Gyeonggi-do (KR); Jae-Man Cho, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/671,650

(22) Filed: Sep. 26, 2003

(65) Prior Publication Data

US 2004/0060524 A1 Apr. 1, 2004

(30) Foreign Application Priority Data

Sep. 27, 2002 (KR) ..... 10-2002-0058774
Oct. 4, 2002 (KR) ..... 10-2002-0060652

(51) Int. Cl.[7] ..... F02B 75/18; F01P 3/02
(52) U.S. Cl. ..... 123/41.28; 123/41.29
(58) Field of Search ..... 123/41.1, 41.05, 123/41.28, 41.29, 41.82 R

(56) References Cited

U.S. PATENT DOCUMENTS 1,680,567 A * 8/1928 Marsh ..... 123/41.28
1,985,240 A * 12/1934 Brubaker ..... 123/41.29

FOREIGN PATENT DOCUMENTS

JP 03225015 A * 10/1991 ..... F01P/3/02

* cited by examiner

*Primary Examiner*—Tony M. Argenbright
*Assistant Examiner*—Hyder Ali
(74) *Attorney, Agent, or Firm*—Morgan Lewis & Bockius LLP

(57) ABSTRACT

An engine cooling system comprises a coolant inlet formed at one side of a cylinder block for allowing a coolant to separately flow into the cylinder block and a cylinder head, and a coolant outlet formed at the other side of the cylinder head for allowing the coolant having flowed into the cylinder block and the cylinder head to separately flow out of the cylinder block and the cylinder head. The coolant outlet is formed diagonally opposite to the coolant inlet. The coolant delivered from a water pump separately flows into the cylinder block and cylinder head, whereby a cooling efficiency of the engine is improved.

9 Claims, 6 Drawing Sheets

ENGINE COOLING SYSTEM

CROSS-REFERENCE TO RELATED APPLICATIONS

This application claims priority of Korean Application Nos. P2002-58774, filed on Sep. 27, 2002 and P2002-60652, filed on Oct. 4, 2002, the disclosures of which are incorporated fully herein by reference.

FIELD OF THE INVENTION

The present invention relates to an engine cooling system and, more particularly, to an engine cooling system in which coolant flows separately in the cylinder block and the cylinder head of the engine, thereby improving the cooling efficiency of the engine.

BACKGROUND OF THE INVENTION

Conventional engine cooling systems maintain normal operating temperatures irrespective of traveling conditions. A water cooling system, which is one of the cooling systems for cooling engines, basically comprises a water pump for forcibly delivering a coolant, a radiator for cooling a high-temperature coolant, and a thermostat for controlling the flow of the coolant on the basis of the temperature of the coolant.

Such a water cooled engine is typically provided with a water jacket with channels formed in a cylinder block and in a cylinder head of a conventional engine, respectively, through which the coolant flows. However, the water jacket formed in the cylinder block of the engine has a coolant inlet and a coolant outlet, which are typically formed in the same area toward the intake side of the engine. Consequently, the coolant does not uniformly flow to the vicinities of cylinder bores of the engine, whereby the cooling efficiency of the engine is very low.

In a conventional engine cooling system, the water jacket formed in the cylinder block communicates with the water jacket formed in the cylinder head, which leads to a sharing of the coolant. As a result, the coolant delivered from the water pump is supplied to the cylinder head via the cylinder block. Consequently, insufficient cooling of the cylinder head results in it having a temperature higher than that of the cylinder block as fuel in the engine is combusted.

SUMMARY OF THE INVENTION

Embodiments of the present invention provide an engine cooling system which is capable of causing coolant delivered from a water pump to separately flow in the cylinder block and the cylinder head of the engine, thereby improving the cooling efficiency of the cylinder block and the cylinder head.

In accordance with a preferred embodiment, an engine cooling system comprises a coolant inlet formed at one side of a cylinder block for allowing coolant to separately flow into a cylinder block and cylinder head. A coolant outlet is formed at the other side of the cylinder head for allowing the coolant having flowed into the cylinder block and the cylinder head to separately flow out of the cylinder block and the cylinder head, the coolant outlet being diagonally opposite to the coolant inlet.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

A preferred embodiment of the present invention will now be described in detail with reference to the accompanying drawings.

Figure 1:
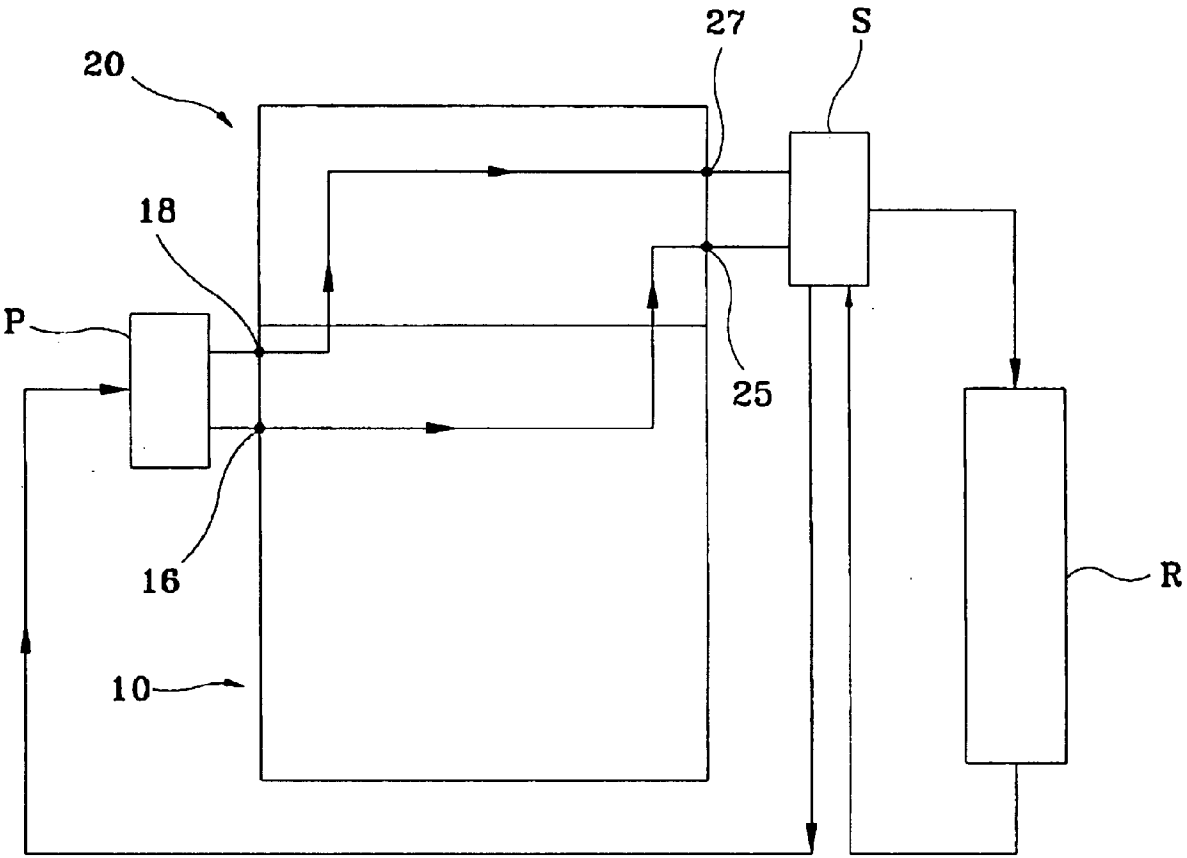
FIG. 1 is a schematic block diagram showing an engine cooling system according to a preferred embodiment of the present invention.
Figure 2:
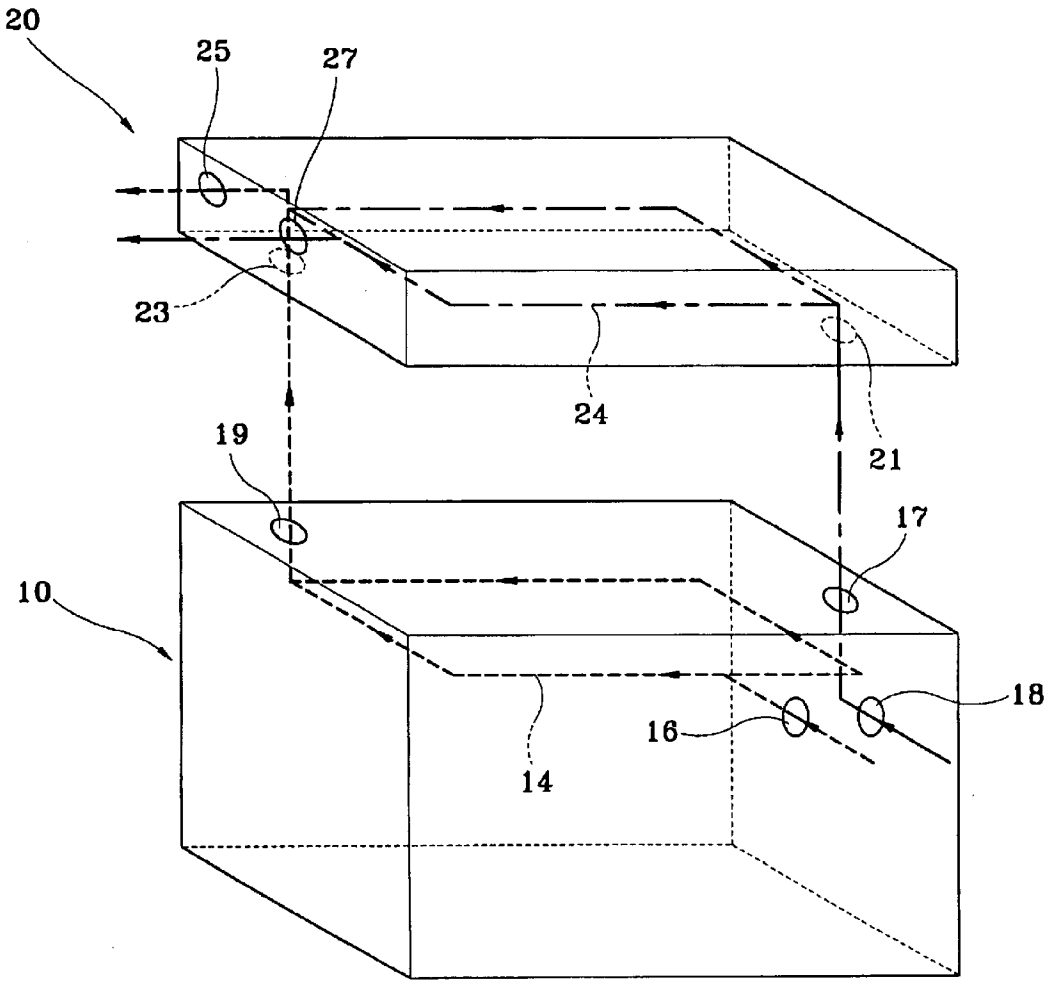
FIG. 2 is a schematic block diagram showing coolant flow channels of the engine cooling system according to the present invention in a cylinder block and in a cylinder head, respectively.
Figure 3:
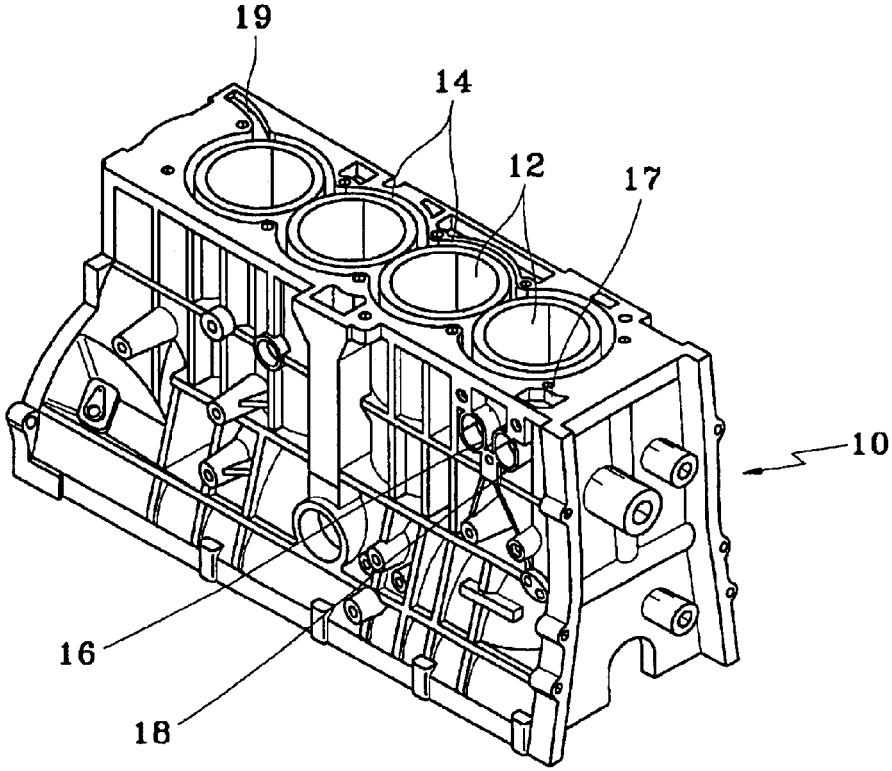
FIG. 3 is a perspective view showing a cylinder block to which the engine cooling system of the present invention is applied.

As shown in FIGS. 1 to 3, an engine cooling system comprises a coolant inlet formed at one side of a cylinder block 10 for allowing a coolant to separately flow into the cylinder block 10 and a cylinder head 20. A coolant outlet is formed at the other side of the cylinder head 20 for allowing the coolant having flowed into the cylinder block 10 and the cylinder head 20 to separately flow out of the cylinder block 10 and the cylinder head 20. The coolant outlet is formed diagonally opposite to the coolant inlet.

The coolant inlet formed at one side of the cylinder block 10 is located at the exhaust side of the engine disposed closer to the rear of a car body in an engine compartment, and the coolant outlet formed at the other side of the cylinder head 20 is located at the intake side of the engine disposed closer to the front of the car body in the engine compartment.

In the cylinder block 10 are arranged, in a line, a plurality of liners 12, each of which forms a cylinder bore. Along the circumference of the liners 12 is formed a water jacket 14. In the cylinder head 20 mounted on the cylinder block 10 is formed another water jacket 24 along the circumference of combustion chambers. The water jacket 24 serves as a coolant flow channel for guiding coolant flow.

The coolant inlet formed at the exhaust side of the cylinder block 10 comprises a plurality of inlet holes separately communicating with the outlet of a water pump P. Specifically, the coolant inlet comprises a first inlet hole 16 directly communicating with the water jacket 14 formed in the cylinder block 10, and a second inlet hole 18 directly communicating with the water jacket 24 formed in the cylinder head 20.

Figure 4:
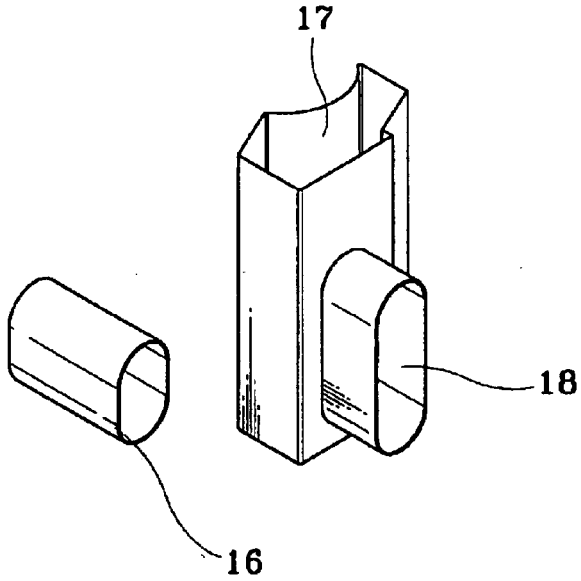
FIG. 4 is an enlarged perspective view of the coolant inlets shown in FIG. 3.

As shown in FIG. 4, the first inlet hole 16 is formed in the shape of a straight through-hole communicating with the water jacket 14 formed in the cylinder block 10, and the second inlet hole 18 is formed in the shape of an upwardly bent through-hole communicating with the water jacket 24 formed in the cylinder head 20 mounted on the cylinder block 10.

The cross sections of the first inlet hole 16 and the second inlet hole 18 are curved, respectively, so that the flow resistance of the coolant is reduced when the coolant delivered from the water pump P separately flows into the water jacket 14 of the cylinder block 10 and the water jacket 24 of the cylinder head 20 through the first inlet hole 16 and the second inlet hole 18, respectively.

Figure 5:
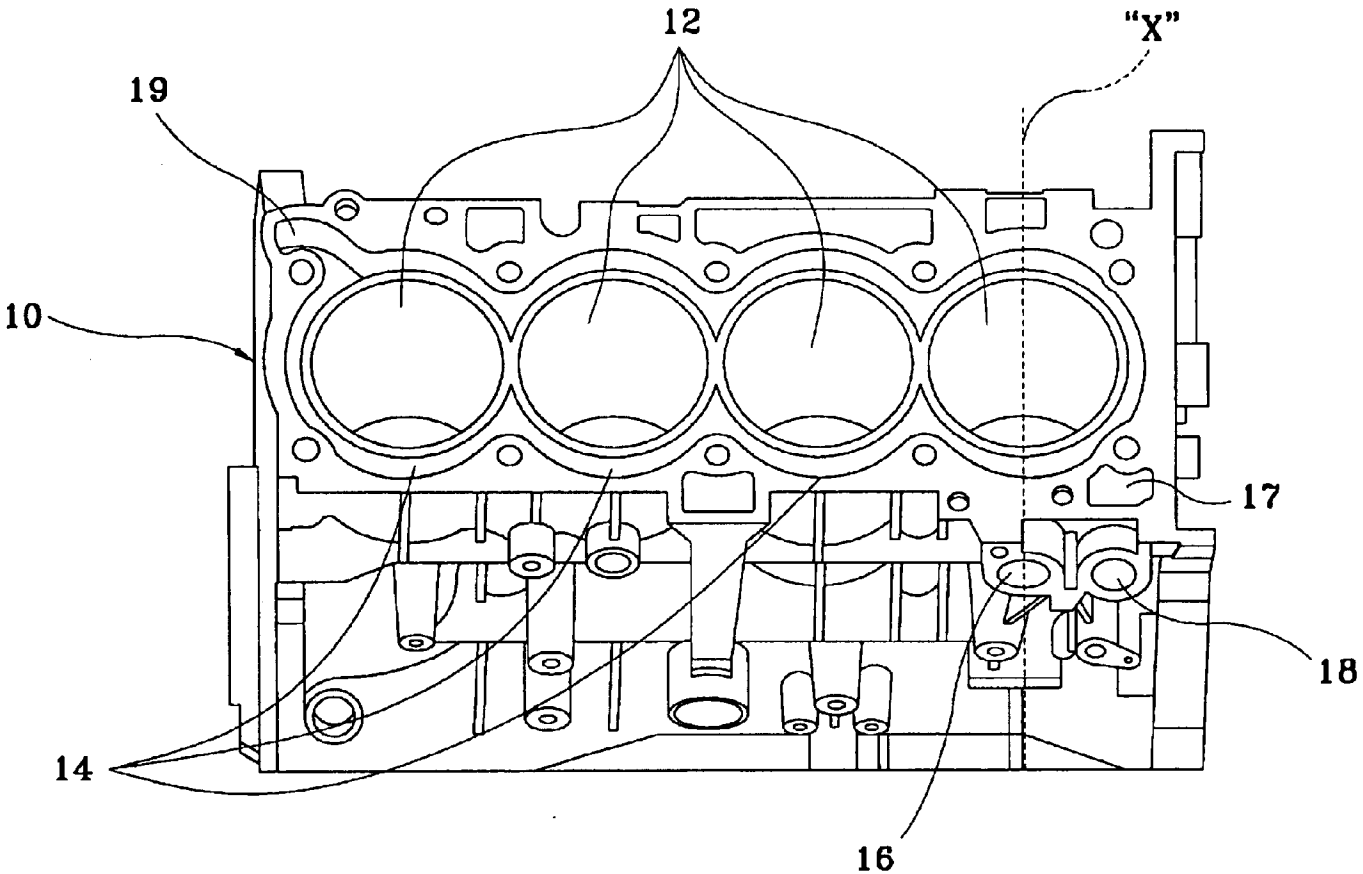
FIG. 5 is a perspective view showing the cylinder block of FIG. 3 from a different direction.

The center of the first inlet hole 16 is on the central axis X of the first cylinder liner 12, which is closest to the coolant inlet in the cylinder block 10, as shown in FIG. 5. Consequently, the coolant introduced through the first inlet hole 16 is uniformly distributed to both sides of the first cylinder liner 12 about the first cylinder liner 12 so that the circumference of the liners in the cylinder block 10 are uniformly cooled.

At the upper part of the cylinder block 10, which is located at the exhaust side of the cylinder block 10, is formed a first intermediate outlet hole 17 communicating with the second inlet hole 18 of the coolant inlet.

Figure 6:
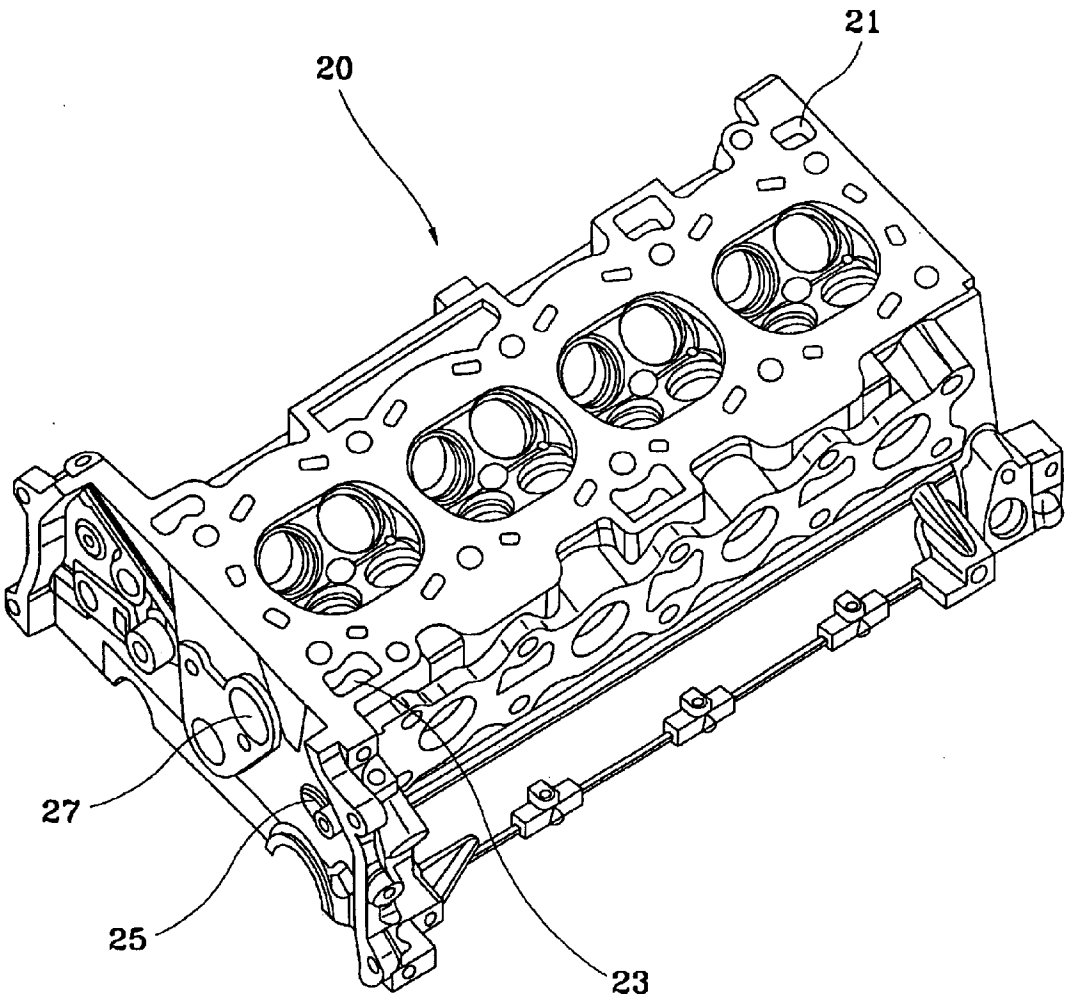
FIG. 6 is a perspective view showing a cylinder head to which the engine cooling system of the present invention is applied.

At the lower part of the cylinder head 20 is formed a first intermediate inlet hole 21 communicating with the first intermediate outlet hole 17, as shown in FIG. 6. Consequently, the coolant delivered from the water pump P passes through the second inlet hole 18 and the first intermediate outlet hole 17 formed in the cylinder block 10, and is then introduced into the water jacket 24 formed in the cylinder head 20 through the first intermediate inlet hole 21 formed in the cylinder head 20.

The first intermediate outlet hole 17 of the cylinder block 10 directly communicates with the water jacket 24 formed in the cylinder head 20 via the first intermediate inlet hole 21.

At the upper part of the cylinder block 10, which is located at the intake side of the cylinder block 10, is formed a second intermediate outlet hole 19, through which the coolant having passed in the water jacket 14 is guided to the cylinder head 20. The second intermediate outlet hole 19 of the cylinder block 10 is formed diagonally opposite to the first inlet hole 16 of the cylinder block 10.

Consequently, when the coolant introduced into the water jacket 14 formed in the cylinder block 10 from the water pump P through the first inlet hole 16 is guided to the cylinder head 20 through the second intermediate outlet hole 19, the coolant is uniformly distributed along the circumference of the liners 12 so that the liners and the other parts of the cylinder block 10 are uniformly cooled.

At the lower part of the cylinder head 20 is formed a second intermediate inlet hole 23 communicating with the second intermediate outlet hole 19 of the cylinder block 10. The second intermediate inlet hole 23 does not communicate with the water jacket 24 formed in the cylinder head 20. Consequently, it is easily understood that the coolant separately flowing in the water jacket 14 of the cylinder block 10 and the water jacket 24 of the cylinder head 20 flows along two separate flow channels.

At the intake side of the cylinder head 20 is formed the coolant outlet, through which the coolants discharged from the water jacket 14 of the cylinder block 10 and the water jacket 24 of the cylinder head 20 are guided to a thermostat assembly S. The thermostat assembly S is composed of one or more thermostats.

Figure 7:
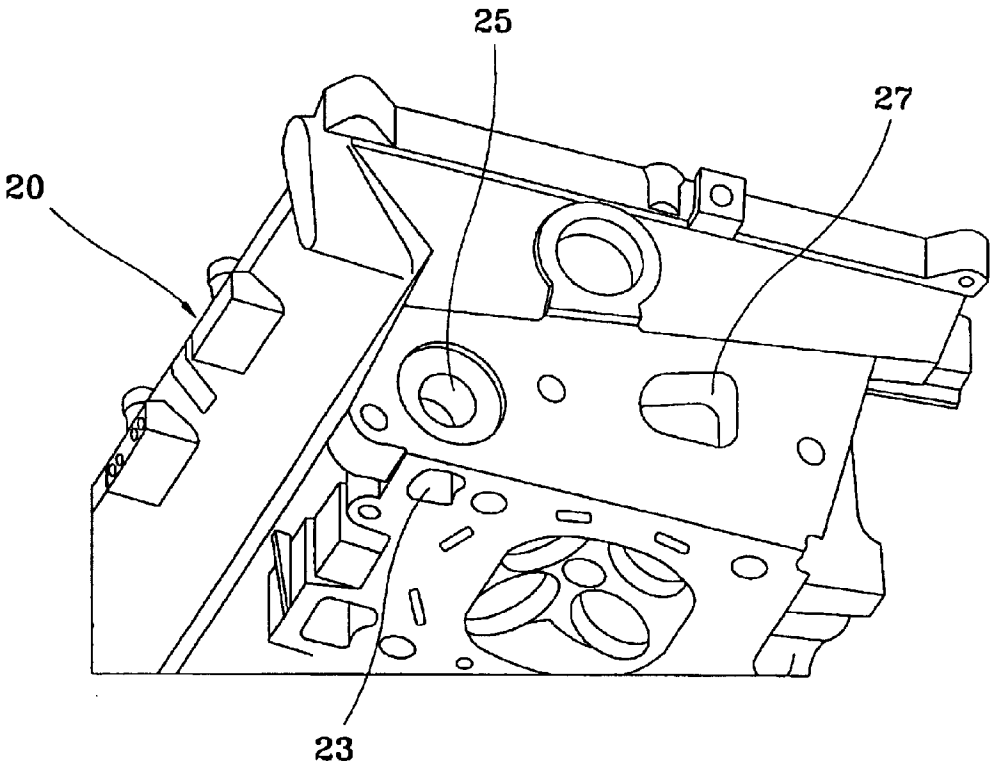
FIG. 7 is a perspective view showing the cylinder head of FIG. 6 from a different direction.

As shown in FIG. 7, the coolant outlet comprises a first outlet hole 25 communicating with the second intermediate inlet hole 23 for guiding the coolant discharged from the water jacket 14 of the cylinder block 10 to the thermostat assembly S. A second outlet hole 27 is formed near the first outlet hole 25 for guiding the coolant introduced into the water jacket 24 of the cylinder head 20 through the first intermediate outlet hole 17 of the cylinder block 10 to the thermostat assembly S.

The coolants separately discharged through the first outlet hole 25 and the second outlet hole 27 are directed to the water pump P or a radiator R on the basis of the operation of the thermostat assembly S, which is switched on or off depending upon the temperature of the coolant.

In the engine cooling system with the above-stated construction, therefore, the coolant delivered from the water pump P is introduced through the coolant inlet formed at the exhaust side of the cylinder block 10.

A portion of the coolant delivered from the water pump P is supplied to the water jacket 14 formed in the cylinder block 10 through the first inlet hole 16, and is then introduced into the second intermediate inlet hole 23 of the cylinder head 20 through the second intermediate outlet hole 19 diagonally opposite to the first inlet hole 16. The coolant introduced into the second intermediate inlet hole 23 is discharged to the thermostat assembly S through the first outlet hole 25.

The rest of the coolant delivered from the water pump P is supplied to the water jacket 24 formed in the cylinder head 20 through the second inlet hole 18, the first intermediate outlet hole 17 and the first intermediate inlet hole 21, and is then discharged to the thermostat assembly S through the second outlet hole 27 formed diagonally opposite to the second inlet hole 18.

Consequently, the coolant delivered from the water pump P separately flows in the water jacket 14 of the cylinder block 10 and the water jacket 24 of the cylinder head 20.

After the coolant is discharged to the thermostat assembly S from the water jacket 14 of the cylinder block 10 and the water jacket 24 of the cylinder head 20, the coolant may be delivered to the water pump P in two ways, which is selected by the thermostat assembly S disposed at the side of the coolant outlet of the cylinder head 20 on the basis of the temperature of the coolant.

When the temperature of the coolant is below a predetermined temperature, the coolant discharged from the thermostat assembly S is bypassed to the water pump P. When the temperature of the coolant is above the predetermined temperature, on the other hand, the coolant discharged from the thermostat assembly S is introduced into the radiator R, and is then supplied to the water pump P via the thermostat assembly S.

The high-temperature coolant discharged through the coolant outlet is naturally cooled by air while the vehicle is running since the intake side of the engine is disposed closer to the front of the car body in the engine compartment.

As apparent from the above description, the present invention provides an engine cooling system which is capable of causing coolant delivered from a water pump to separately flow in a cylinder block of the engine and in a cylinder head of the engine, thereby improving the cooling efficiency of the cylinder block and the cylinder head.

Furthermore, a coolant outlet is disposed closer to the front of the car body in an engine compartment so that the high-temperature coolant discharged through the coolant outlet is naturally cooled by air while a vehicle is running, thus improving the cooling efficiency of the coolant.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An engine cooling system, comprising:

a coolant inlet formed at one side of a cylinder block for allowing coolant to flow into said cylinder block; and a coolant outlet formed at a side of a cylinder head opposite said side of the cylinder block for allowing the coolant having flowed along said cylinder block and said cylinder head to flow out of said cylinder head, said coolant outlet being diagonally opposite to the coolant inlet;

wherein said coolant outlet comprises a first outlet hole for allowing the coolant discharged from a water jacket of said cylinder block to flow therethrough and a second outlet hole for allowing the coolant discharged from a water jacket of said cylinder head to flow therethrough.

2. The system as set forth in claim 1, wherein the coolant introduced through said coolant inlet is discharged through said coolant outlet along different flow channels formed in said cylinder block and said cylinder head, respectively, without mixing in said cylinder block and said cylinder head.

3. The system as set forth in claim 2, wherein said coolant inlet comprises:

a first inlet hole communicating with a water jacket formed in said cylinder block; and a second inlet hole communicating with another water jacket formed in said cylinder head.

4. The system as set forth in claim 3, wherein the center of said first inlet hole is formed at a central axis of a first cylinder liner of said cylinder block.

5. The system as set forth in claim 3, wherein said cylinder block has a first intermediate outlet hole communicating with said second inlet hole, and wherein said cylinder head has a first intermediate inlet hole communicating with said first intermediate outlet hole.

6. The system as set forth in claim 1, wherein said cylinder block has a second intermediate outlet hole for allowing the coolant to flow to said cylinder head therethrough, said second intermediate outlet hole being diagonally opposite to said coolant inlet, and wherein said cylinder head has a second intermediate inlet hole communicating with said second intermediate outlet hole of said cylinder block.

7. The system as set forth in claim 6, wherein said second intermediate inlet hole does not communicate with said water jacket formed in said cylinder head.

8. The system as set forth in claim 1, wherein said coolant inlet is disposed closer to the rear of a car body in an engine compartment and said coolant outlet is disposed closer to the front of the car body in the engine compartment.

9. An engine cooling system, comprising:

a cylinder head defining a coolant passage and first and second coolant inlets;

a cylinder block configured to couple with said cylinder head, said cylinder block defining;

a coolant passageway;

first and second coolant inlets positioned on a first side of said cylinder block, wherein the first coolant inlet directs coolant to flow through said coolant passageway of said cylinder block and said second coolant inlet directs coolant to flow through said coolant passage in said cylinder head; and a first and a second coolant outlet formed at a side of said cylinder head opposite said side of said cylinder block defining said coolant inlets, wherein said first coolant outlet allows coolant to be discharged from said passageway of said cylinder block and said second coolant outlet allows coolant to be discharged from said coolant passage of said cylinder head, and wherein said coolant outlets are diagonally opposite said coolant inlets.

* * * * *